US005464495A

United States Patent [19]

Eder

[11] Patent Number: 5,464,495

[45] Date of Patent: Nov. 7, 1995

[54] METHOD AND APPARATUS FOR APPLYING LABELS TO CONTAINERS AND CONTAINERS RESULTING THEREFROM

[75] Inventor: Erich Eder, Donaustauf, Germany

[73] Assignee: Krones AG Hermann Kronseder Maschinenfabrik, Neutraubling, Germany

[21] Appl. No.: 71,464

[22] Filed: Jun. 2, 1993

Related U.S. Application Data

[63] Continuation-in-part of Ser. No. 820,132, Jan. 13, 1992, abandoned.

[30] Foreign Application Priority Data

Aug. 1, 1991 [DE] Germany ..... 41 25 472.4

[51] Int. Cl.[6] ..... B65C 9/04

[52] U.S. Cl. ..... 156/456; 156/446; 156/458; 156/519; 156/521; 156/568

[58] Field of Search ..... 156/358, 363, 156/446, 450, 458, 519, 521, 566, 568, DIG. 25, DIG. 26, 499, 583.1, 583.3

[56] References Cited

U.S. PATENT DOCUMENTS

| | | | |
|---|---|---|---|
| 3,659,394 | 5/1972 | Hartleib et al. . | |
| 4,406,721 | 9/1983 | Hoffmann | 156/80 |
| 4,545,832 | 10/1985 | Hoffmann | 156/86 |
| 4,574,020 | 3/1986 | Fosnaught | 156/80 |
| 4,735,668 | 9/1986 | Hoffmann et al. | 156/215 |
| 4,801,348 | 1/1989 | Takagaki | 156/456 |
| 4,832,774 | 5/1989 | DiFrank et al. | 156/215 |
| 5,024,046 | 6/1991 | Spatafora et al. | 53/466 |
| 5,108,537 | 4/1992 | Garnes et al. | 156/583.1 |

FOREIGN PATENT DOCUMENTS 4014274 6/1991 Germany .

OTHER PUBLICATIONS

U.S.-Book: Dullinger, Karl; *Krones Manual of Labeling Technology;* 1975, pp. 20–22.

DE-Buch: Dullinger, Karl; *Handbuch der Etikettierung;* Hersung. Hermann Kronseder, Neutraubling, s. 20–22.

*Primary Examiner*—Robert A. Dawson
*Assistant Examiner*—David Reifsnyder
*Attorney, Agent, or Firm*—Ryan, Kees & Hohenfeldt

[57] ABSTRACT

Containers are transported on rotatable support plates which are arranged in a circle on a rotating turntable. The leading edge of a label is adhered to a container as it orbits past a vacuum-type label transfer drum. A curved guide which is tangential to the cylindrical body of the container as the orbiting and rotating container passes it causes the label to wrap completely around the container. One of a circular array of heat sealing elements which are rotating with the turntable adjacent each support plate is cammed radially outwardly of the turntable into contact with the region on the container where the trailing end overlaps the leading end of the cable. This fuses the ends of the labels together. The cam profile is adjustable in length to keep the time during which the heat sealing member is in contact with the label ends overlap constant independently of the rotational speed of the turntable.

42 Claims, 10 Drawing Sheets

METHOD AND APPARATUS FOR APPLYING LABELS TO CONTAINERS AND CONTAINERS RESULTING THEREFROM

This is a continuation-in-part application of Ser. No. 07/820,132, filed Jan. 13, 1992, now abandoned.

BACKGROUND OF THE INVENTION

The invention disclosed herein pertains to a method and apparatus for applying and sealing labels to containers and to the containers resulting from treatment with the method.

A machine for applying and sealing labels to containers is described in U.S. Pat. No. 4,694,633. In this machine, each container is supported on a rotating disk so that the container rotates, as it is carried by a turntable, to serve as a mandrel about which the label is wrapped. At the start of container rotation, a vacuum bar is driven into juxtaposition with the container periphery. The vacuum bar attracts the leading end of a label and carries the label around the container sufficiently for the trailing end of the label to overlap the leading end. At this time, the overlapped ends are subjected to a heating element or a jet of hot air which seals the trailing end to the leading end of the label. The vacuum bar is then withdrawn. This leaves a free space between the label and the container so the label fits loosely on the container. Thus, the additional step of heat shrinking the entire label onto the container is required. The machine is only suitable for applying labels which are heat-shrinkable. Heating the entire surface of the label on the container is expensive and can result in wrinkles developing in the label. The machine is also not suitable for labeling prefilled aerosol cans which cannot be heated safely. Moreover, the thin suction bar and associated control mechanism are costly to manufacture and are vulnerable to damage.

Another machine for wrapping labels around rotating containers is disclosed in U.S. Pat. No 4,272,311. In this machine, containers are conveyed in a straight line past an application station where a web of labels is drawn from a supply roll. Adhesive is applied at the interface of the leading edge of the label and the container. The leading edge of the web is then pressed against the container by means of a revolving belt. The individual label is cut from the web only after the web is partially wrapped around the container. To provide time for cutting, the web is stopped with a clamping device and the label which is already in contact with the container is torn or cut from the web along a perforated web. The label is then continuously rotated by reason of being in contact with the belt until the label is completely wrapped around the container. The overlap region of the leading and trailing ends of the label can be joined by having previously applied adhesive to the trailing end of the label or the trailing end can be sealed to the leading end by applying heat to the overlapped region. One disadvantage of the machine is that the adhesive-coated label is not separated from the web until the label is partially wrapped around the container which requires that the web be stopped for severing the label. This is obviously disadvantageous in that the method is intermittent rather than continuous which results in its product output being low. When the machine is driven at higher speeds, there is not sufficient time allowed for a reliable fusion of the leading and trailing edges of the label to achieve a good seal. Consequently, applying adhesive to a large area on the inside of the label or to the outside of the container is often necessary. This is highly disadvantageous, particularly in the application of labels composed of thin and transparent film, for reasons of appearance. The known apparatus is not suitable for achieving high production rates of 40,000 to 80,000 bottles or cans per hour as is a common requirement in the beverage industry today.

U.S. Pat. No. 4,416,714 discloses applying an adhesive coated leading end of a label to a rotating container to effect wrapping of the label on the container. The label is secured by adhering the trailing end over the underlying leading end. Labels are fed, one at a time, to the containers from a vacuum drum. Heat shrinking of the edges of the label to the contour of the container is disclosed, but heat sealing the overlapped label ends in addition to having adhesive applied near the trailing end as is described herein is not disclosed.

Japanese Patent No. Sho 57-23620, published May 19, 1982, discloses wrapping a heat shrinkable label around a container and heat sealing the overlapping trailing and leading ends of the label. The top and bottom edges of the label are heat-shrunk to conform them to the contour of the container. A back-up bar is placed behind the overlapping ends, at least along the edges which extend over the contour, to allow pressing the overlapping ends together by a hot heat seal member or a cold member when the label ends are sealed with glue. There is no disclosure of how the heat sealing time can be held substantially constant for different container transport speeds as is described herein.

SUMMARY OF THE INVENTION

The general object of the invention is to provide a method and apparatus for applying labels comprised of sealable material to containers and to provide a container which is unique insofar as its relationship with the label is concerned.

A further object of the invention is to provide a labeling machine which is capable of high product output and is distinguished by its minimal cost and high reliability.

The new labeling method and machine exhibits a continuous method in which a label is cut from a label web, the leading edge is applied and adhered to a rotating container, the label is wrapped tightly onto the container with no intervening space, and the trailing edge of the label overlaps the leading edge and is sealed to the leading edge. The method requires using only a small amount of adhesive, applied either to the leading edge of the label or to the container, to attach the leading edge of the label to the container rotating it to cause wrapping of the label around the container. Only sufficient adhesive is used on the leading edge to ensure that the label does not slip from the container during wrapping. The label is actually secured about the container when the trailing end of the label overlaps the leading end and the overlap region is heat sealed. The result is an extremely fast labeling method which produces containers on which the label is smooth and attractive even though a very thin or transparent film-type label is used. The width or height, as opposed to the length, of the label can be dimensioned so that the upper and lower longitudinally extending edges of the label extend over radially inwardly tapered top and bottom margins of the container such that only the longitudinal edges, rather than the whole label, need to be heat shrunk to cause the edges to conform to the contour of the container. The adhesive selected to attach the leading edge of the label to the container is preferably one whose adhesive strength diminishes with time following sealing. This is permissible since the label is tightly conformed to the container surface by the tight wrapping and by shrinking the upper and/or the lower longitudinally extending edges. When suitable label material is used on containers composed of plastic material, the adhesive can be a solvent that forms a tacky area when applied to the label or the container. This allows the label to be attached to the container for a short but sufficiently long time for the labels to be wrapped around the container but which provides for part of the adhesive effect to be dissipated after a few minutes or after longitudinal edges of the label are subjected to heat radiated from an electric heating element or from a jet of hot air projected on the edges of the label while the container is still rotating.

In any case, when only a short time elapses between completion of the label wrapping step and heat sealing the overlapping ends of the label, it is necessary that the trailing edge of the label remains on the container during that time. This is achieved by mechanically pressing the label against the container, for example, or preferably by attaching the label to the container tentatively with narrow adhesive strips applied in the region just behind the trailing edge but with overlapping leading and trailing edges, which are to be subject to heat sealing, kept free of adhesive. The advantage of having the adhesive near the trailing end of the label but not extending to the end is that only one layer of adhesive, the layer on the leading end, lies in the region,where the ends overlap for heat sealing. The result is a more inconspicuous seal which is one objective of the invention.

When applying labels whose upper and lower longitudinal edges do not follow the contour of the container after the label is wrapped, it is advantageous for the unadhered lower and upper edge or edges of the label to be backed up or supported on the inside facing the container so that the overlapping ends of the label can be sealed along the full height or width of the label. This assures that the upper and lower edges of the label in the region of overlapping will not separate or split open when the edges are subjected to heat shrinking.

An important feature of the invention is that the sealing time for the labels can be held constant independent of the present operating speed of the machine. This allows the labeling machine to be incorporated into a production line which has preceding and subsequent processing stages without the quality of the sealed seam being adversely affected, that is, without the application of too much or too little heat when there are variations in the operating speed at the input or output side of the new labeling machine.

How the foregoing briefly mentioned features of the new labeling method, resulting article and machine are achieved and implemented, will appear in the following more detailed description of a preferred embodiment of the invention wherein reference is made to the accompanying drawings.

DESCRIPTION OF A PREFERRED EMBODIMENT

Figure 1:
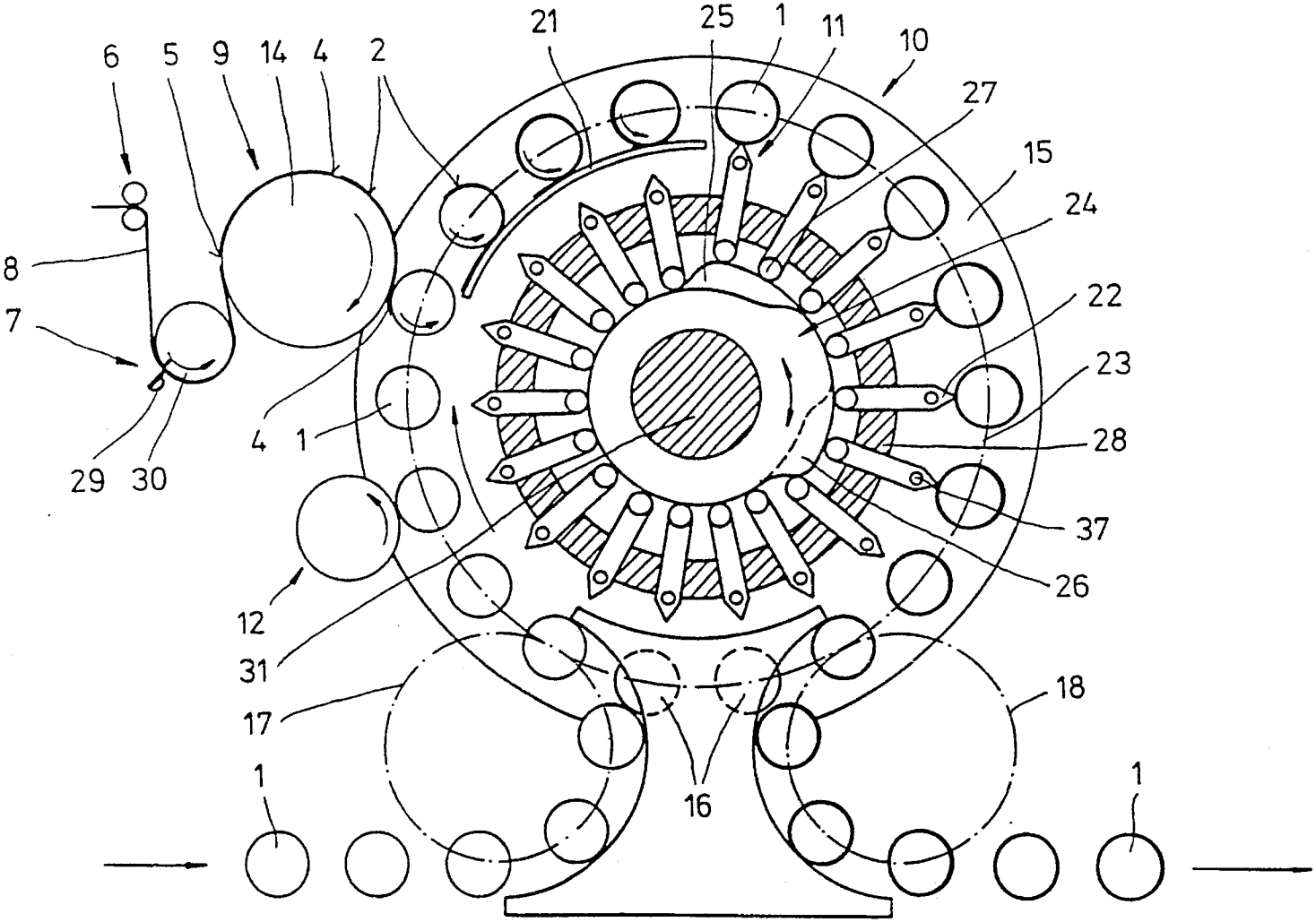
FIGS. 1–4 are schematic top plan views of the new labeling machine with its cover removed and respectively depicting four different embodiments of the invention.

The labeling machine illustrated in FIG. 1 has a turntable 15 which is driven rotationally about a vertical axis and carries several rotationally driven plates 16 which are shown in dashed line circles where they are not supporting a container 1 which is to be labeled. One of the dedicated control devices 20, depicted only in FIG. 9, which causes the respective rotary plates 16 to undergo a particular rotational sequence during a revolution of turntable 15. The containers 1 to be labeled are transferred to the rotary plates 16 in succession from a circular infeed conveyor 17 which is shown schematically. There is a conventional centering container stabilizing bell 19, shown in FIG. 9, for each rotary plate 16. The centering bell 19 can be raised and lowered with the help of which containers 1, after being transferred from infeed conveyor 17, are clamped with an axially directed force to the associated container supporting rotary plate 16.

Positioned in the region directly behind the infeed conveyor 17, radially outwardly of clockwise rotating turntable 15, is an adhesive applicator 12, commonly called a glue roller, which applies a strip of glue directly on the passing containers 1. The adhesive applicator 12 is basically a rotating roller which, when glass bottles or metal cans are the containers, applies preferably hot adhesive to the container or label or applies a solvent to the container or label when the container is composed of plastic material. The adhesive pattern formed on the container or label by the applicator 12 depends on the configuration of the surfaces of the container and the adhesive roller. If the body of the container and the periphery of the adhesive applicator roller are cylindrical, they make a tangential contact along a line which results in a narrow vertical strip of adhesive being transferred to the container. When hot melt adhesive is used, it is only necessary to apply adhesive to a few points to the leading edge of the label to hold it in place so that the adhesive applicator roller will have several projecting annular lands, not visible, axially spaced apart one above the other. The resulting glue pattern in such case is illustrated by the three adhesive strips depicted in FIG. 8.

Upstream of glue applicator 12 in the rotational direction of the turntable 15, a label transfer device 9 is positioned for depositing individual labels 2, which have been separated from a roll of labels, on containers 1. The label transfer device 9 in this particular embodiment constitutes a rotationally driven vacuum cylinder 14 which rotates synchronously with turntable 15 and, in this embodiment, in the same direction. The labels 2, which are cut to size already, cling to vacuum cylinder 14 after having been separated from an incoming web of labels by a cutting device 7 positioned adjacent the vacuum cylinder 14. The web is fed through web delivery pinch rolls 6 at a rate which is synchronous with the machine output from a supply roll, not shown, so that the labels 2 are positioned with their graphics facing the vacuum cylinder. The device which severs the individual labels from the web consists of a stationary blade 29 and a rotating blade 30 on the rotating vacuum cylinder.

Oppositely of the main vacuum cylinder 14 and radially inwardly of the rotary plate 16 orbit 23 there is a curved stationary guide element 21 whose outer surface lies adjacent the containers 1. As the labels 2 are wrapped about the containers in succession, guide element 21 guides the free end of the label which is not yet on the container 1 and simultaneously pulls the label taut so that it fits tightly on the container. The guide element 21 is preferably supplied with vacuum orifices, not shown, to enhance attraction of the labels. The length of guide element 21 is such that its downstream or trailing end guides the trailing end of the label at least until the label is completely wrapped around the container such that the overlap between the leading and trailing ends of the label is formed in the region 3 which is identified in FIG. 8.

Radially inwardly of the rotary plate 16 orbit 23 is a circular guide frame 28, shown in section, which holds radially reciprocable heat sealing members 22. Guide frame 28 revolves with turntable 15. The number of heat sealing members 22 carried on guide frame 28 corresponds to the number of rotary plates 16 on turntable 15. The sealing members 22 are positioned to cooperate with the respective rotary plates 16. There is an electric heater cartridge 37 on each sealing member. Positioned inside of the guide frame 28 is a control device 24 which drives the heat sealing members 22 radially outwardly. Control device 24 comprises first and second superimposed radial cams 25 and 26 which are adjustable rotationally in relation to each other in the rotational direction of turntable 15 or in the opposite direction. Each heat sealing member 22 has on its radially inward end a guide roller 27 which is spring biased into contact with radial cams 25 and 26. The spring which holds each roller in contact with cams 25 and 26 is not shown.

The first or upper radial cam 25 of control device 24 is held stationary on a central machine support 31 in this embodiment while the lower or second radial cam 26 is rotationally adjustable about stationary center support 31 by means of an actuation device, not shown, between two limit positions. The upper or first radial cam 25 determines the beginning of the heat sealing step by forcing a heat sealing member 22 radially outwardly into contact with the label overlap, while the trailing edge of the lower or second radial cam 26 determines the end of the heat sealing step. Offsetting the lower cam 26 relative to the upper cam 25 enables the turntable rotational angle during which a heat sealing member 22 bears on the overlapping trailing and leading label ends in the region 3 of label 2 to be enlarged or reduced in size in proportion to the present rotational speed of turntable 15. Because the second or lower radial cam 26 is continuously adjustable within limits, the sealing time can be kept constant within limits by varying the control angle. In other words, the heat application angle is increased or largest when the output rate is high and is reduced as the output rate decreases.

Figure 9:
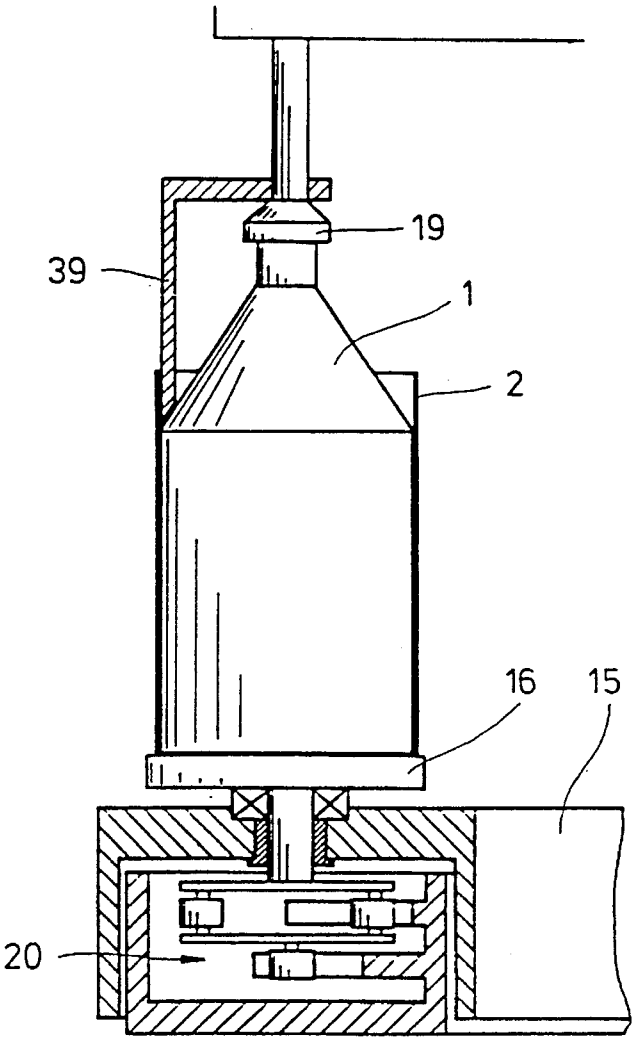
FIG. 9 shows a vertical section through the outer rim or periphery of the turntable of a labeling machine, such as in FIGS. 1–4, showing how the container is subjected to an axially downwardly applied axial force which holds it firmly to a rotating disk, this figure also illustrating how the upper longitudinal edge of a label which extends over the inwardly tapered part of the container is backed up with an element which prevents the upper edge of the label from collapsing inwardly when the overlap is being sealed.

The advancing edge of the first or upper cam 25 is positioned so that the sealing members 22 are pushed radially outwardly shortly before the trailing end of the fixed guide element 21 is reached and are applied to the overlapping end region 3 of a label 2 immediately beyond the end of guide element 21. The edge of the lower or second radial cam 26 begins shortly before the outfeed conveyor 18 is reached, and at the latest, so that the heat sealing members 22 can be pulled by spring action radially inwardly again to provide for removal of containers 1 from turntable 15 and for transferring of the containers to outfeed conveyor 18. At the moment transfer of a container from the turntable to the outfeed conveyor 18 occurs, the centering bell 19, depicted in FIG. 9, is lifted so that the container is free to be carried away on the outfeed conveyor.

The rotational or oscillation sequence of the container support plates 16 is such that a container 1 is set into rotary motion counter to the turntable 15 after passing the adhesive applicator 12 or upon reaching the label transferring vacuum cylinder 14, at the latest. After termination of the label wrapping step resulting from at least one complete revolution of the container, the rotary motion of the container relative to the turntable 15 stops for the sealing step with the overlapping label end region 3 pointing inwardly toward the sealing member 22 which is traveling along with it. In other words, the heat sealing member 11 is maintained in contact with the region 3 in which the leading end of the label is overlapped by the trailing end after the turntable orbits the container beyond guide 21. It should be remembered that the trailing end of the label will not have adhesive directly on it in the overlapping or sealing region and that the adhesive applied to the leading end is set back out of the overlapping region by a small amount.

Figure 2:
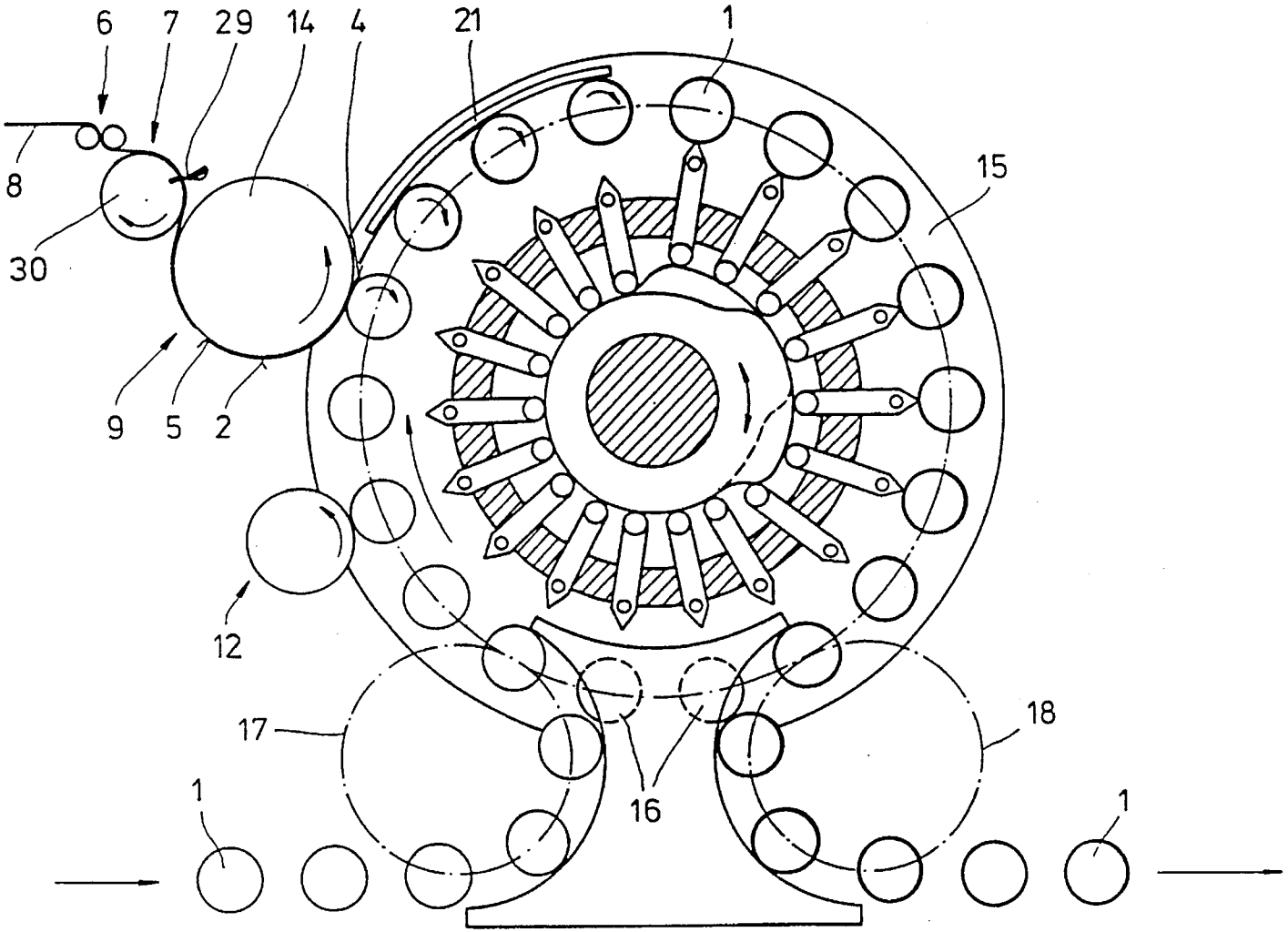

The alternative embodiment of the new labeling machine depicted in FIG. 2 is basically the same as that shown in FIG. 1 but differs in respect to the motion relationships in the area of the label transfer device 9 and in the wrapping of the labels around containers 1. In contrast to the FIG. 1 embodiment, the vacuum cylinder 14 in the FIG. 2 embodiment is driven counter-rotationally to the direction of turntable 15. In other words, in FIG. 2 the turntable 15 is rotating clockwise and the vacuum drum 14 is rotating counterclockwise. In this case, at the moment of label transfer from vacuum cylinder 14 to a container 1 and during subsequent wrapping of the label around the container, the container is moved by rotary plate 13 in the rotational direction of the turntable so that a container 1 is rolled slip-free on the vacuum cylinder 14 when the leading edge of the label is delivered. Because the containers 1 rotate in the same direction as the turntable 15 in the FIG. 2 embodiment, the stationary guide element 21 is positioned radially outwardly of the container orbit which is outlined by the dashed circular line 23.

The FIG. 2 embodiment makes it possible to process labels which are longer than those which can be handled in the FIG. 1 embodiment with a turntable 15 having the same divisional scale and it offers more favorable transfer conditions at the vacuum cylinder 14.

Since the electrically heatable sealing members 22 are positioned radially inwardly of the rotary plate orbital path 23, as in the FIG. 1 embodiment, but the overlap region at the ends of label 2 point radially outwardly after wrapping the label, the container must be turned at least 180° for sealing, so that the overlapped region is positioned opposite of a heat sealing member 22. To prevent the trailing edge 5 of the label from falling off the container during the 180° of rotation, it must be attached to the container until the sealing member 22 is pressed against the label overlapping ends of the container. For instance, attachment of the trailing end of the label to the container can be achieved mechanically by a method, wherein a pressing or guiding element is provided for each rotary plate and container 1 thereon and revolves with them and is applied to the container at least by the time the container reaches the departing end of the stationary guide element 21, to hold the trailing part of the label 2 on the container until the overlap region 3 is aligned with and contacted with a sealing member 22. A pressing or guiding element, of this kind is mounted for radial movement on circular guide frame 28 and actuated by an associated control device, similar to the control device depicted in FIG. 9 for actuating heat sealing members 22. A pressing device is illustrated in FIG. 11 to which attention is now invited.

Figure 5:
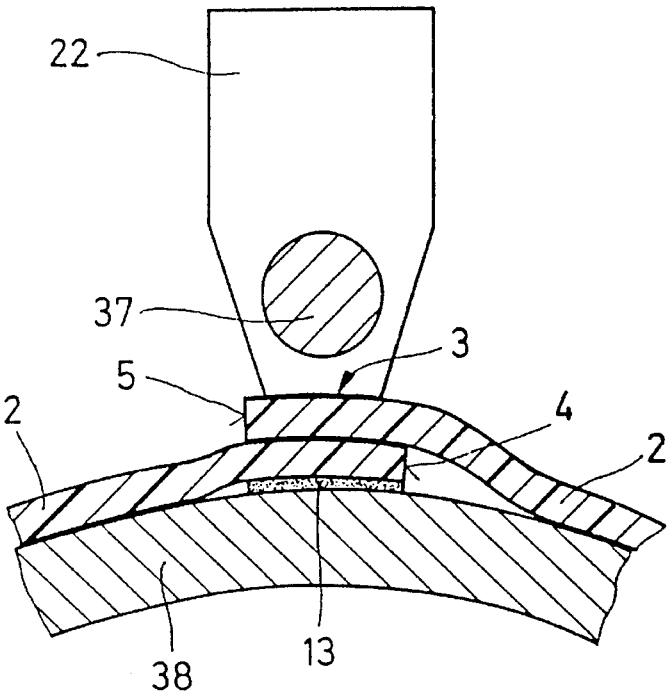
FIGS. 5–7 show cross-sections through the overlapping leading and trailing ends of a label container wherein there are, respectively, different adhesive patterns.
Figure 11:
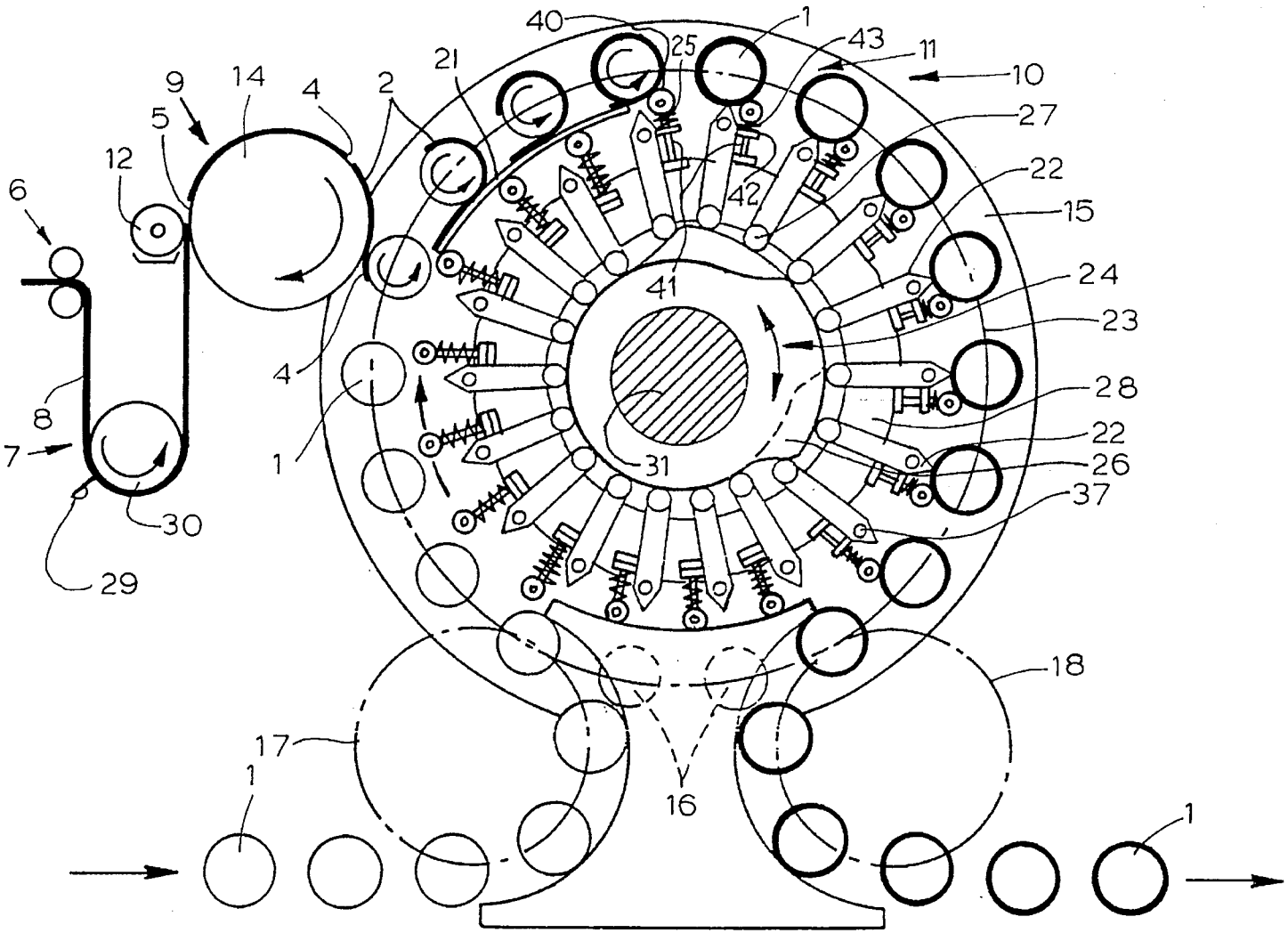
FIG. 11 is a top plan view of the new labelling machine, basically similar to FIG. 1, with the cover removed from its turntable for illustrating an additional feature of the labelling machine, namely, the use of spring biased rollers for stabilizing the trailing end of the label until the moment when a heat sealing member contacts the trailing end of the label to fuse it to the leading end.

Before considering FIG. 11, note in FIG. 5 that there is no adhesive between where the trailing end 5 of the label overlaps the leading end 4. Note also that the heat sealing is done along a narrow band marked 3. FIG. 11, shows one approach to preventing the trailing end of the label possibly becoming misaligned with the leading end or otherwise being inaccurately positioned on the container as a result of the lack of adhesive for controlling the trailing end of the label. Without some corrective measure, the trailing end of the label would be a free flap until heat sealing occurs.

The solution demonstrated in FIG. 11 is to provide rollers 40, which are operative to press the free trailing end of the label against the container to stabilize the trailing end after it separates from the curved guide member 21 at least until the heat sealing member 22 initiates fusing the trailing end to the leading end. Pressing rollers 40 are mounted for rotation on the end of radially inwardly and outwardly movable shafts 41 in FIG. 11. The shafts are slidable in brackets 42 that are mounted to the heat sealing members 22. A spring 43 urges the shaft and roller 40 radially outwardly of the tip of the heat sealing member 22. Thus, as the container comes off guide 21 the container stops rotating and the roller leads the heat sealing member in making first contact with the labelled container. This results from the heat sealing member 22 being driven radially outwardly by stationary cam 24, 26. When contact is made with the container by roller 40, the spring 43 is compressed, and the trailing end of the label is held against the container. As the turntable 15 continues revolving, the heat sealing member 22 rides up on the highest part of cam 24, 26 and contacts the container to initiate making the heat seal along a vertical band on the container indicated by the numeral 3 in FIG. 5.

Note, in FIG. 11 that the applicator roller 12 is positioned for applying two dots of adhesive directly to the leading end of the label even before the label is cutoff on transfer drum 14. On the other hand, in FIGS. 1–4, the adhesive applicator roller 12 is positioned for applying at least two dots of adhesive directly to the container. It will be evident that the leading end of the label can be tacked onto the rotating container by adhesive dots that are interposed between the leading end and the container by either of the two adhesive roller modalities.

Figure 12:
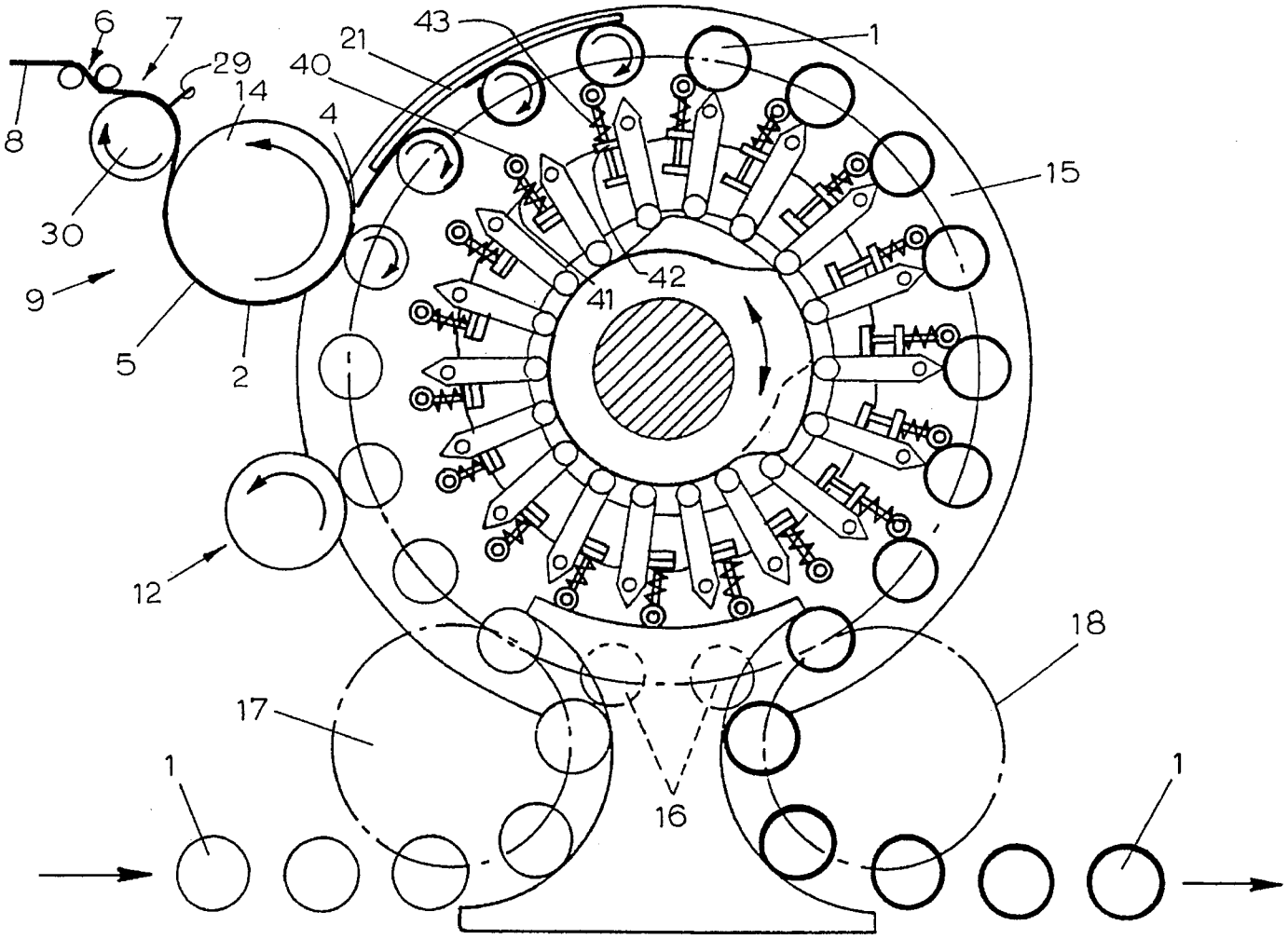
FIG. 12 is a top plan view, similar to FIG. 2, except that roller members are added for stabilizing the trailing end of the label until the moment the heat sealing member makes contact with the container for fusing the trailing end of the label to the leading end.

The trailing end pressing devices shown in the FIG. 12 modification are arranged for the situation where the containers are driven rotationally in a direction counter to the direction in which the turntable 15 revolves. This corresponds to the situation in FIG. 2 where the curve guide member 21 that participates in wrapping the label around the container fixed on the turntable 15 is positioned radially outwardly of the periphery of the containers. In FIG. 12, one container is still rotating at it is about to depart from stationary guide member 21. The pressing devices and their components are given the same reference numerals as in FIG. 11. In FIG. 12 the pressing devices are mounted to the opposite side of heat sealing member 22 compared with FIG. 11, but the pressing devices perform essentially the same function of coming in against the body of the container and holding the label prior to the heating element tip, making contact with the label end overlap to initiate fusion of the trailing end to the leading end of the label.

Figure 6:
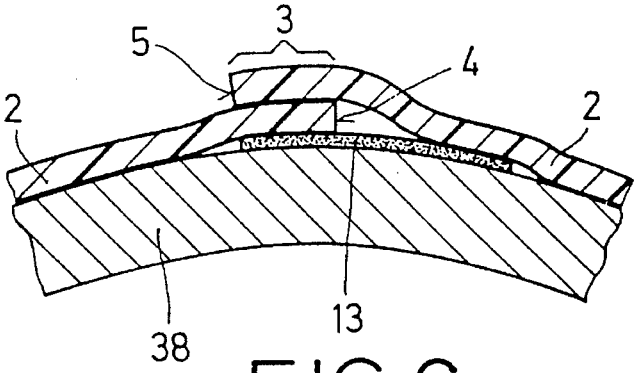
Figure 8:
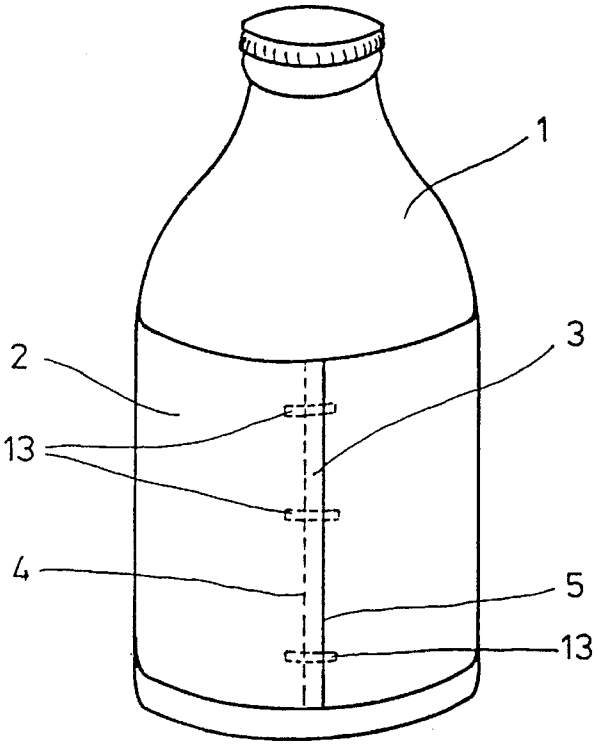
FIG. 8 is a perspective view of a label container which has an adhesive pattern on the label corresponding with the pattern shown in FIG. 6.

As shown in FIGS. 6 and 8, the trailing edge 5 of the label 2 can be held on the container by attaching the trailing edge similarly to the leading edge, but with a narrow adhesive region or points, applied before the overlap region 3 of the label 2 is secured by sealing. In other words, the adhesive dots or line is applied near the trailing edge but not so close to the trailing edge as to be coincident with any part of the area at the trailing edge which overlaps the leading edge. In comparison to the FIG. 1 embodiment, this modification requires no additional mechanical parts. When the leading edge 4 of the label is applied to container 1 by vacuum cylinder 14, the rotation of the container 1 with rotary plate 16 must merely be adjusted relative to rotation of the vacuum cylinder 14 in the area of the transfer device 9 so that leading edge 14 of the label does not completely cover the regions previously applied to the container by the adhesive applicator 12. Thus, that part of the leading edge of the label is free of adhesive. This not yet coated part of the adhesive region comes into contact with the label in the area of the trailing edge 5 of the label during subsequent wrapping but the overlapping region 3 is kept free of adhesive for subsequent heat sealing.

Figure 3:
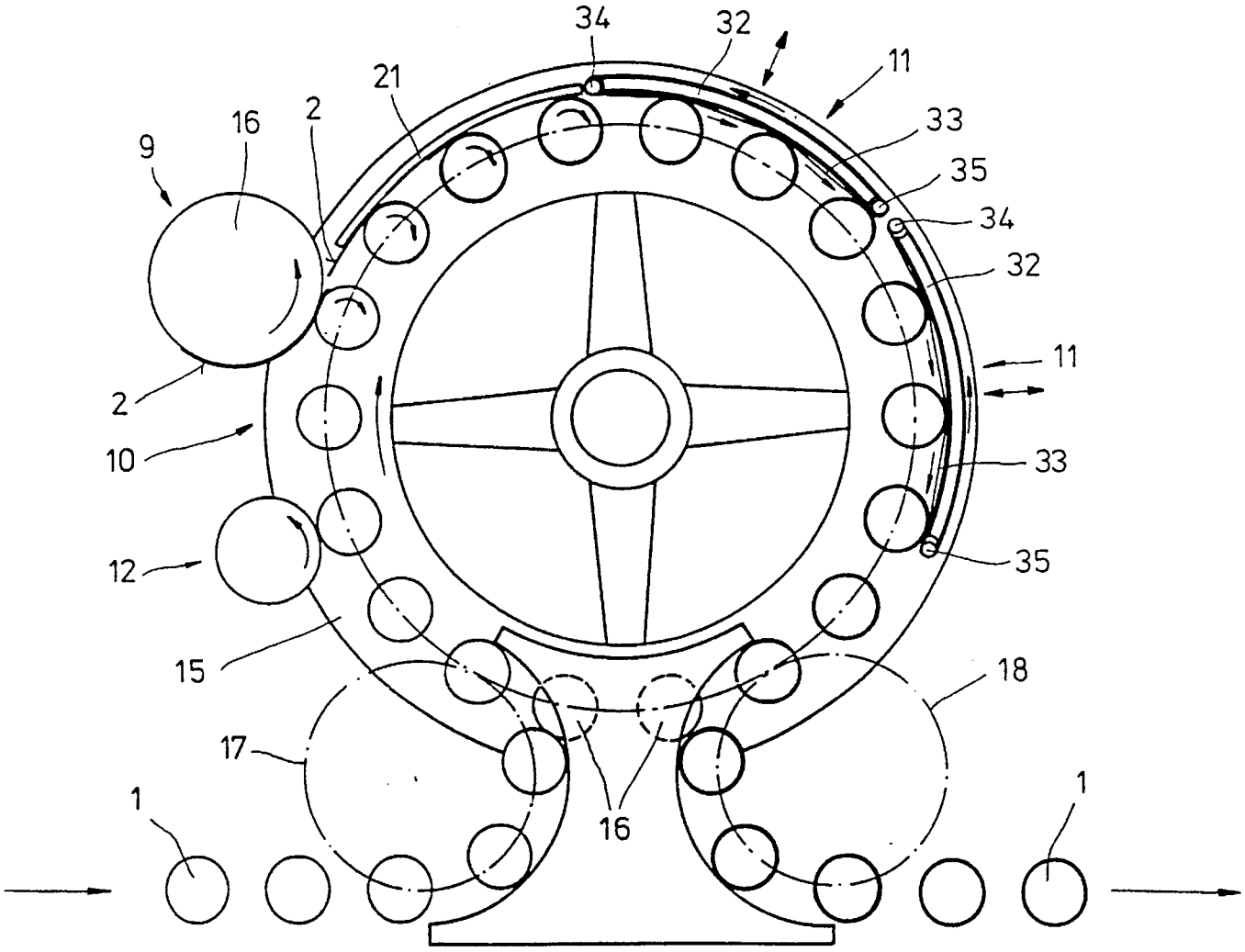

Another alternative embodiment is illustrated in FIG. 3. It differs from the FIG. 2 embodiment in that it has a different heat sealing device 11. The heat sealing device in FIG. 3 is a curved heating element 32 which is held stationarily radially outward of the orbital path 23 of the containers and is encircled by a thin, heat resistant but heat transmissive belt 33 of film-like material such as that which is known by the trademark TEFLON. The belt 33 is diverted or directed by deflection rollers 34 and 35 at each end of the heating element. The deflection roller 35 is driven rotationally synchronously with the current rotational speed of turntable 15 so that belt 33 bears against container 1 and travels slip-free with it.

The process of wrapping a label 2 on a container 1 in the FIG. 3 embodiment is the same as in the FIG. 2 embodiment, for example, until the aft end of the guide element 21 is reached. However, after wrapping a label on a container is complete, the rotary motion of container 1, activated by a control device 20 of the rotary container support plate 16, is stopped near the aft end of the guide element 21 so that the region 3 where the ends of the label overlap faces radially outwardly of the turntable and in this position is conducted past the heat sealing device or element 11 while the container is orbiting with the turntable but it is not rotating relative to the turntable.

As shown in the FIG. 3 embodiment, heat sealing can be apportioned between one or more heating elements 11 which are positioned in succession on the turntable adjacent the course 23 followed by the rotating containers. The heating elements can be shifted away from the containers radially outwardly with actuation devices, not shown, to adapt the sealing rate to different machine outputs. At full capacity, both heat sealing elements 11 assume their radial inside position, whereas at half capacity, for instance, one element 33 is shifted radially outward or deenergized to avoid overheating. This allows at least one-step adaptation of sealing time to different machine output. If the labeling machine should fail to stop because of a malfunction, all heat sealing members 11 can be shifted to the outer disengaged position simultaneously.

Figure 4:
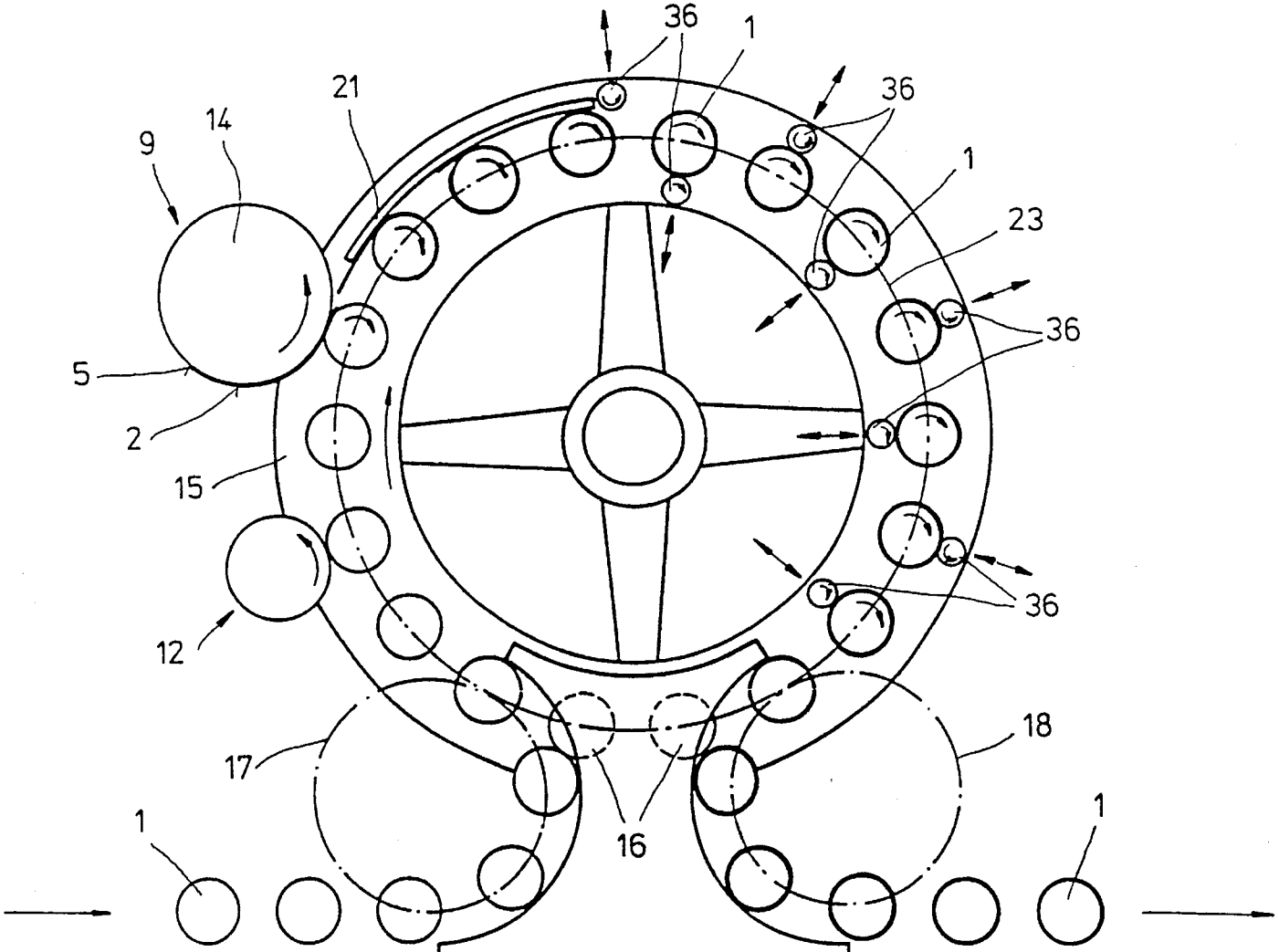

In the FIG. 4 embodiment of the labeling machine, the sealing device consists of several heated sealing rollers 36 positioned in staggered sequence inside and outside of the container orbit 23. In contrast to the previously .described embodiments, the containers 1 are still continuously rotated about their own axes in the same direction by the control device for the rotary plate 16, even after completion of the wrapping process, as they travel through the sealing region. The stationary heatable sealing rollers 36 are positioned in staggered sequence on the turntable 15 so the overlapped region 3 is always briefly pressed by one of the sealing rollers 36 in alternation when it faces the respective radial inside or outside. To avoid slipping between the label surface and the surface of the sealing rollers 36, the rollers are driven synchronously with the speed of the label surface which is clinging to the container. By means, not shown in detail, the sealing rollers 36 can be drawn away from the containers radially inwardly or outwardly, respectively, so that the sealing time can be adapted to the present output of the labeling machine or to the operating speed of turntable 15 as is the case in the FIG. 3 embodiment.

Figure 7:
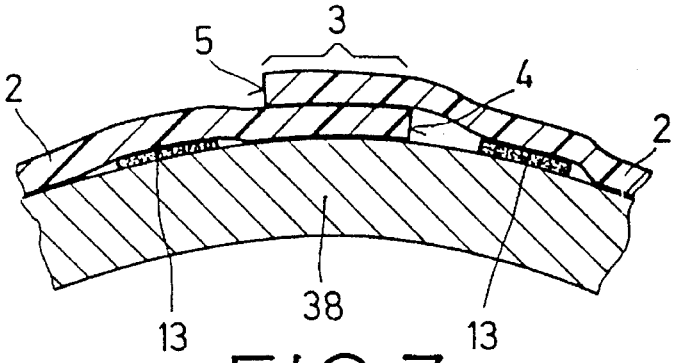

FIGS. 5–7 show a section through a part of a container where the leading and trailing ends of the label overlap. In these figures, sealing of the label ends is completed. The three embodiments in FIGS. 5–7 differ only in respect to the adhesive regions 13 used on the labels 2.

In the FIG. 5 option, only the leading edge 4 of the label is attached to the periphery or outside of the container wall 38 through narrow adhesive regions 13. The trailing end of the label is held to the leading end exclusively by the heat seal in the overlap region 3. It will be understood that the adhesive region 13 can be shifted laterally a certain distance from the leading edge of the label so it no longer lies directly in the overlapping region 3. As is also shown, the trailing edge 5 in FIG. 5 can be sealed to the leading edge of the label by a sealing member 22 that is movable radially in relation to container 1 and can be adjustably heated by previously mentioned rod-shaped electric heating cartridge 37. To prevent the label material from sticking to the sealing member 22 due to the heat of the sealing process, at least the part of the sealing member which interfaces with the label surface can desirably be coated with TEFLON. The sealing effect is influenced not only by the adjustable and controllable temperature of the sealing members 22 but also by the pressure of the members against the container. The sealing members 22 are therefore biased by springs, not shown, which at the same time compensate for tolerable variations in the diameters of the containers which may occur.

Figure 10:
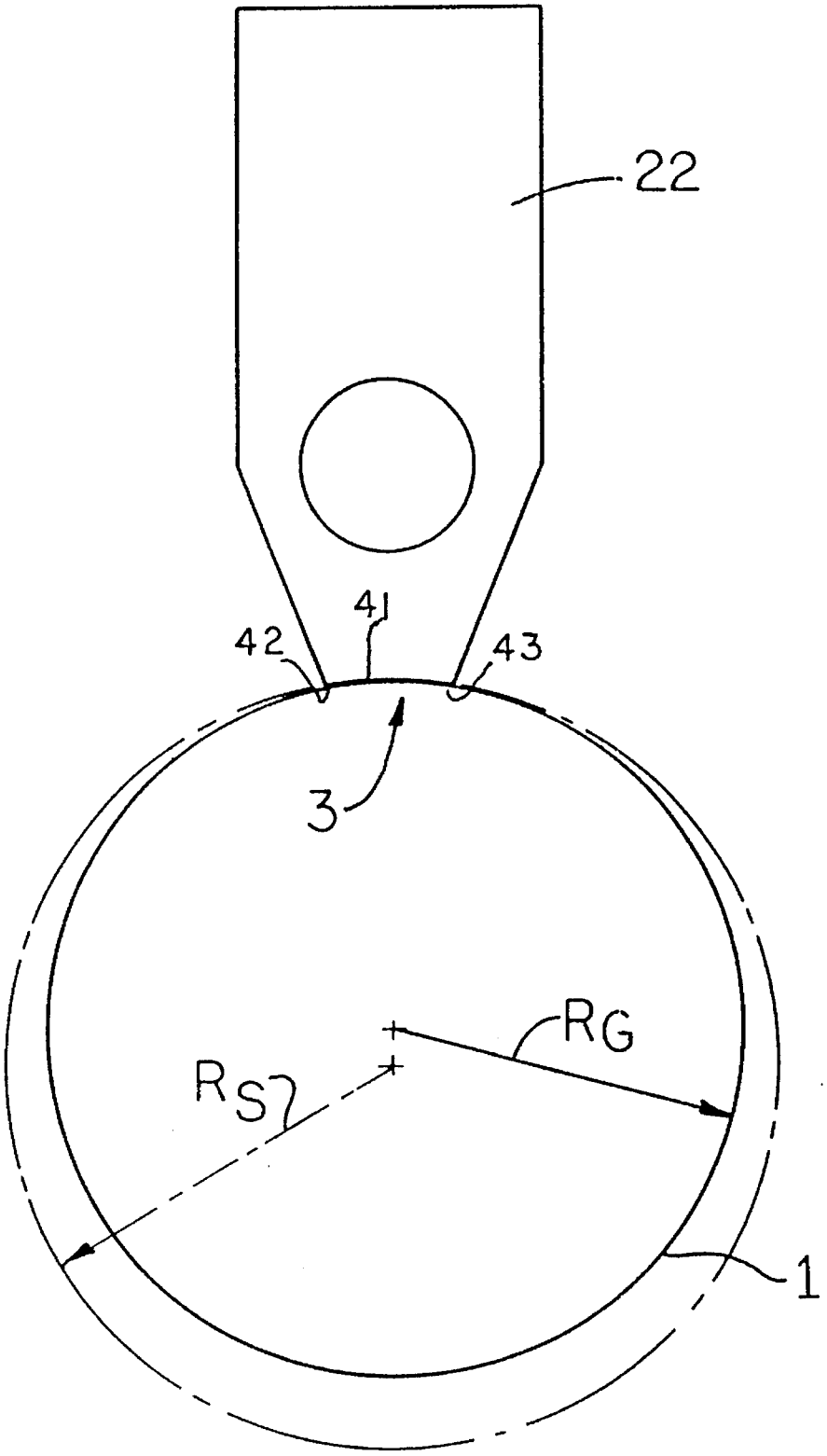
FIG. 10 is a diagram used for illustrating and explaining that the radius of curvature of the heat sealing member is greater than the radius of curvature of the container where the member interfaces with the label and is subjected to heat sealing.

Attention is invited to FIG. 10 for a discussion of the manner in which the hot curved surface 41 heat sealing member interfaces with the overlapped label ends of the container 1. The container 1 is shown as a solid line circle that has a radius $R_g$. The radius of the heat sealing member surface 41 is $R_s$, which is a little greater than $R_g$. The heat sealing member face 41 is rigid and is in the shape of an arc of the phantom line circle, which is an extrapolation of the arc. Thus, the center of the heat sealing member curved face makes contact with the trailing end of the label on the container 1 about where the lead line from the reference numeral touches the container in FIG. 10. Each sealing line or narrow strip is identified by the numeral 3 in FIGS. 5–7. The gaps at the outer edges 42 and 43 of the heat sealing member interfacing surface 41 in FIG. 10 do not make contact with the container because of the container having a smaller radius than the radius of curved surface 41 though the difference in the radii are small so that the gaps at 42 and 43 cannot be visualized easily in the drawing. The label 2 is a thin film composed of a heat shrinkable material such as polypropylene or other suitable polymer. The label may have graphics printed on it such as is present on well-known beer and soda water cans whose graphics are applied by photolithographic methods. Applying heat shrinkable plastic films to cans to simulate photolithographically printed cans was not successful until the present invention was made. The beer and soda water canning industries, for example, prefer to use labels rather than photolithography for economic advantages and environmental pollution avoidance. However, prior methods of sealing the overlapping trailing end of a label to its leading end where there is a line of adhesive under the leading end and another line of adhesive between the trailing end and the leading end has not been a practice that is acceptable to the canning industry because the joint between the ends of the label is conspicuous and has poor aesthetic qualities. Heat sealing, where the prior practice of having two layers of adhesive, where the label ends overlap results in a wrinkled and unsightly seam because the quantity of the adhesive under the trailing end boils or bubbles when subjected to heat. The overlap is optically unclear or hazy. According to the invention, where only tiny spots of adhesive are used between the leading end of label and the container and there is no adhesive between the trailing and leading ends where the heat sealing line occurs, the joint is clear and unwrinkled, thus making the labelling machine accomplishing this end attractive to the industry.

In the FIG. 6 embodiment, the adhesive region 13 holds not only the leading edge 4 but also the aft section of the label 2 in the vicinity of its trailing edge 5 to the container wall 38, although the overlap region 3 between the trailing edge 5 and leading edge 4 of the label remains free of adhesive. This is necessary to achieve a flawless seal. The adhesive pattern in FIG. 6 is also discernable in FIG. 8. It is not absolutely necessary that a continuous vertical line of adhesive be applied parallel to the leading edge 4 of the label to obtain satisfactory adhesion and wrapping. Two or three narrow, vertically aligned and slightly horizontally extending adhesive stripes or dots are sufficient. These can be applied with an adhesive roller 12 having radially projecting annular lands acting directly on the containers or with spray nozzles, not shown.

The application of adhesive only at certain points or dots, as indicated in FIG. 8, can also be used with the adhesive arrangement of FIGS. 5 and 7. FIG. 7 shows an adhesive pattern similar to that of FIG. 6 but differs in that no adhesive is applied between the leading edge 4 of the label and the container wall 38 in the overlapped region. Each adhesive region 13 is a certain distance from the leading edge 4 or the trailing edge 5 of the label. The advantage of this is, because there is no superimposed mass of material and adhesive, the overlapping region 3 lies tightly against the container wall 38 after it is sealed which makes a less visible or invisible seal.

The adhesive patterns of FIGS. 5–7 can be applied, not only directly onto the container, as shown in the FIGS. 1–4 embodiments, but also directly on the corresponding regions of the inside surface of the label. The adhesive roller 12 or applicators required for this must then be positioned on the periphery of the vacuum cylinder 14 as shown in FIG. 11. The separated individual labels 2 are held inside out on the vacuum cylinder. To obtain the adhesive pattern of FIG. 5, for example, the vacuum cylinder 14 may have radially movable slides, not shown, in proximity with the leading edge of the label so that a smooth adhesive roller with minimal radial interspace can be placed on the vacuum cylinder 14 to apply adhesive to the leading edge 4 of the label. These slides can also be used to transfer the leading edge 4 of the label from the vacuum cylinder 14 to the container 1 as the container is conveyed past it on the turntable 15. It is immaterial whether tacking the leading end onto the container is applied to the container or to the leading end of the label before it touches the container. In other words, either of the two methods may be used as long as interposing some adhesive such as two dots, preferably, between the leading end of the label and the container is accomplished.

In FIG. 8, the label 2 is attached to the container wall 38 of container 1 using the adhesive pattern of FIG. 6. Although the label 2 is held to the container wall 38 only at certain points by three narrow adhesive strips or dots 13 applied one above the other near the leading end of the label, the trailing end of the label is sealed continuously along its entire length to the leading end.

In processing containers having radially tapered sections at the top or bottom that are to be covered by a label that fits the container contour after the labeling process is complete, the label can be attached first directly to the cylindrical part of the container and then wrapping the label around the container by the previously described method. Then to seal the overlapped region, a support is needed on the inside of the overlap where it is not yet in contact with the outer container wall after wrapping so that it can be sealed along its entire length. After sealing, the extending portions of the label can be shrunk to the container contour by means of heat confined to the extending portions.

FIG. 9 shows a container 1 clamped axially between a rotary plate 16 and a centering bell 19 where the upper edge of the label extends upward beyond the cylindrical region of the container which is clamped between the top and bottom. To support the overlapped region 13 in this extending part of the label, a support surface designed in the form of a tongue 39 is mounted on the centering bell 19. The upper edge portion of the label, where the lead line to the reference numeral 2 is applied, can be subjected to a hot air stream for shrinking that portion radially inwardly to interface with the conical top portion of container 1.

Figure 13:
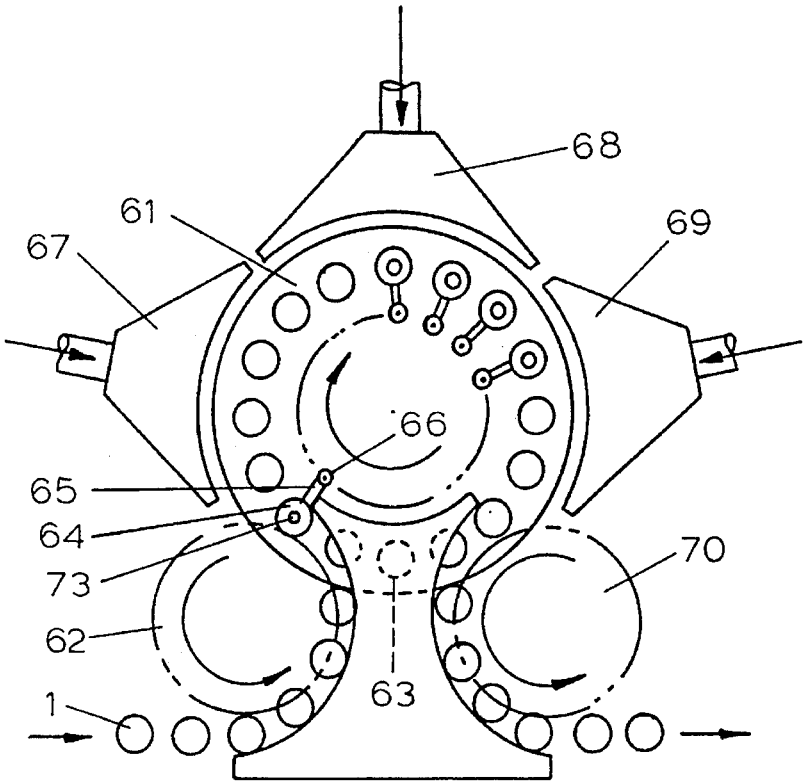
FIG. 13 is a schematic top plan view of a revolving turntable on which the labelled containers rotate while directing a hot air stream against them to cause the label to shrink to the contours of the containers.
Figure 14:
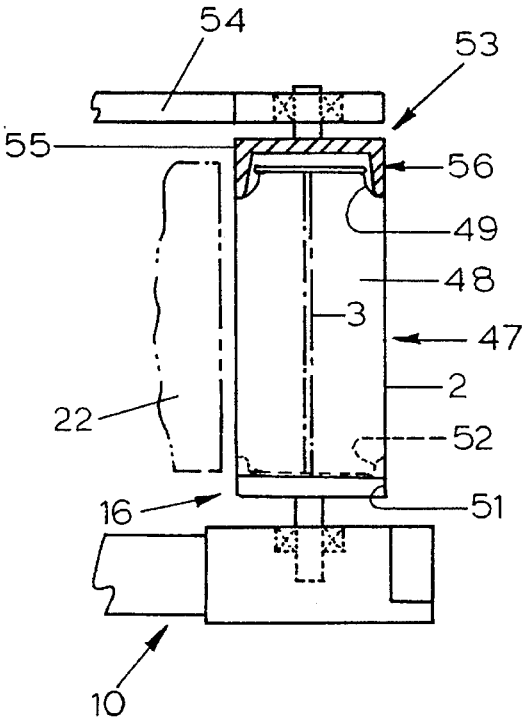
FIG. 14 illustrates a container that has a label wrapped around it where the container is supported on a rotationally driven disk support and a centering device has been engaged with the container to stabilize it as the label is being wrapped around it.

The can 47 illustrated in FIG. 14 is a popular style that is used extensively for containing beer and soda water sold in retail stores. The can is shown supported on support plate 16 which is mounted on the turntable 10 such as the turntable illustrated in FIG. 1. The bottom region 52 of the can is curved radially inwardly of the cylindrical body 48 of the can. The neck 49 of the can is tapered radially inwardly. The can is supported on a support plate 16 on turntable 10 as it would be in any one of the FIGS. 1–4 embodiments of the labelling machine while the heat sealing operation is progress. That is, the trailing end of the label is heat sealed to the leading end by a clear stripe symbolized along the dashed lines marked 3 as the sealing area is also indicated in FIGS. 5–7. Can support 16 has a top surface that complements the non-flat configuration of the can bottom. This augments stability of the can 47 on support 16. The periphery 51 of support 16 is cylindrical and has substantially the same outside diameter as the container. The lower edge portion 52 of the label has an inside diameter about equal to the outside diameter of support 16. Thus, the periphery 51 of support 16 served as a backup member to prevent inward deflection of the lower edge portion of the label when the tip 41 of the heat sealing member 52 presses against and fuses the ends of the label together along the dashed lines indicated by the numeral 3. The concept of backing up the label where it is to be pressed by an object that effects adhesion between the trailing and leading ends of the label is disclosed in Malthouse U.S. Pat. No. 4,447,280, filed Oct. 22, 1981, issued May 8, 1984. The same backup concept is used at the upper end of the can 47 where it is engaged by a centering device 53. The centering device has a cylindrical periphery 55 whose outside diameter is the same as the outside diameter of the cylindrical body of the can. Thus, when the heat sealing member 22 engages the can to heat seal the overlapped trailing end to the leading end of the label, the heat seal member interfaces with a cylindrical backup surface extending from the top edge to the bottom edge of the label. The top edge of the label 2 in FIG. 14 terminates at the point where the arrow 56 touches the cylindrical centering device 55. This is slightly above the top of the can to account for some reduction in the axial height of the label which will occur when the upper edge region of the label is heat shrunk onto the contoured portion 49 of the can neck. After the trailing and leading ends of the label are heat sealed onto the cans, they progress on the turntable for being transferred to the outfeed starwheel 18 in readiness for the upper and lower edges of the label to be heat shrunk onto the contours of the can as will now be discussed in reference to FIGS. 13 and 15.

After the labels are wrapped around the containers and heat sealed as previously described, they are fed to an infeed starwheel 62 in FIG. 13 and transferred from it to turntable 61. The containers are deposited on support disks 63 that rotate as the turntable revolves. When a container I arrives on a support 63, the head 64 of a clamping and centering device comes down to stabilize the container. Head 64 is moved down to clamp a container and up to release it by being fastened to an arm 65 that, in turn, is fastened to a vertically reciprocal rod 66 whose top end is visible in FIG. 13.

As the containers rotate about their own axes and revolve on turntable 61, they pass upper and lower sets of three fan-shaped slotted hot air directing nozzles such as the upper set which is marked 67, 68 and 69 in this illustrative machine. The hot air stream from the nozzles is directed only at portions of the label which are to be heat shrunk. The containers continue in their orbit on the turntable and, having been given enough time for heat shrinking to be completed, arrive at the outfeed starwheel 70 to which they are discharged from the turntable 61.

Figure 15:
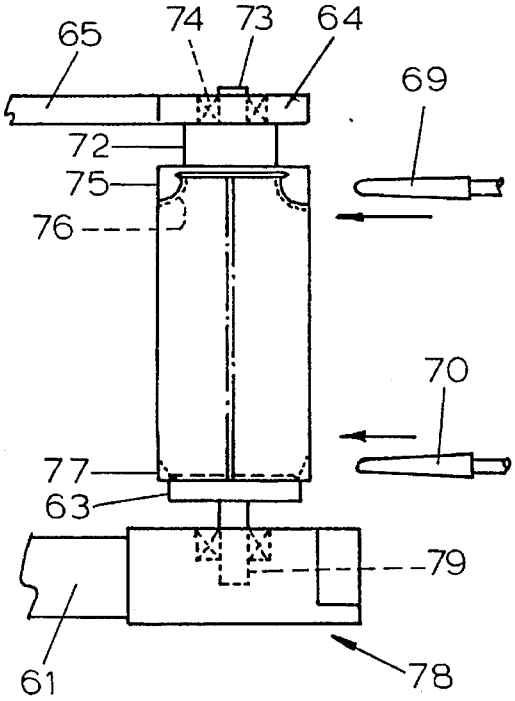
FIG. 15 illustrates the manner in which the container is handled in the FIG. 13 embodiment where the label margins are being heat shrunk to the contours of the containers.

In FIG. 15, the containers are shown to be cans stabilized and ready to begin receiving the hot air label shrinking treatment on turntable 61. A boss 72 on circular head 64 engages the can to stabilize it. The boss has a shaft 73 journaled in head 64 in a bearing 74 so the boss is free to rotate when the can is being driven rotationally from lower support 16. The upper edge portion 75 of the label is not yet heat shrunk onto the radially inwardly slanted neck 76 of the can. The lower edge portion 77 of the label in FIG. 5 is also still not shrunk and, hence, is spaced from the inwardly rounded bottom end of the can. Label lower edge portion 77 is heat shrunk by the hot air stream from nozzle 70 and its counterparts. Label upper edge portion 75 is heat shrunk by the hot air stream from the nozzle 69 and its counterparts.

The outboard region 78 of the turntable 61 contains mechanism, not shown, for rotating the labelled can during heat shrinking. The can support 63 has a shaft 79 that is driven rotationally as the turntable revolves.

In prior practice hot melt adhesives and label material solvents are regularly used to obtain adhesion of the label to the can. If the temperature of the adhesive is a little too low, it is not fluid enough. If it is a little too high, the thin fragile label film will wrinkle at the overlap seam. The problem is aggravated by the fact that adhesion of the overlapping trailing end requires a strip of adhesive co-extensive with the entire height of the label from the bottom edge to the top edge. The seal is not as secure as it is when, in accordance with the invention, the trailing end of the label is heat fused to the leading end.

In the beer making industry, after the cans are filled, labelled and the label is heat shrunk, the cans are transported through a hot ambient for pasteurizing the beer. When the trailing end of the label is fused to the leading end, the heat of pasteurization cannot possibly cause the seam to open.

I claim:

1. Apparatus for applying a label composed of sealable material to a container comprising:

means for drawing a web (8) of labels from a source, means (7) for severing individual labels (2) from the web, a transfer device (14) to which individual labels are transferred in sequence and from which individual labels are transferred to containers (1), respectively, conveyor means (10) for conveying containers past said transfer device to provide for the leading end (4) of the transferred label to be put in contact with and adhere to said container, and means for rotating each container as it is conveyed to effect wrapping of the label around the container for the trailing end of the label to overlap the leading end, means for applying at least one narrow region of adhesive to said container before said leading end is put in contact with the container, the size and location of said region of adhesive being such as to provide for said leading end of the label covering only part of said region while leaving another part exposed for adhering said trailing end of the label to the container at a place spaced for the extremity of the trailing end so when the label is wrapped around, the trailing end overlaps the leading end of the label at a position where there is no adhesive between the trailing and leading ends, and a heat sealing device (11) arranged to contact said label in the region of overlap where there is no adhesive between the trailing and leading end to seal the said trailing end (5) of the label to the leading end (4).

2. The apparatus according to claim 1 wherein said transfer device is a rotationally driven vacuum cylinder for carrying individual labels through a circular path and releasing said leading end of the label for it to contact said container.

3. The apparatus according to claim 1 including container supports on said conveyor means and a centering bell mounted to said conveyor means proximate to each support, said centering bell being operative to engage and stabilize a container after it is loaded onto a support.

4. The apparatus according to claim 1 including an adhesive applicator arranged adjacent said conveyor means for applying said at least one narrow region of adhesive to a passing container on a support before the container reaches said transfer device.

5. Apparatus for applying a heat sealable label to containers, comprising:

a turntable driven rotationally about a vertical axis, a plurality of container supports arranged in circumferentially spaced apart relationship on the turntable for transporting containers in a circular path, infeed means for loading containers onto the supports in sequence, means for turning said supports, respectively, about a vertical axis, a transfer device operative to transport labels individually in succession in a manner such that the leading end of the label contacts a container which is positioned proximate to the transfer device due to rotation of the turntable, means for interposing an adhesive between said leading end of the label and the container for adhering said leading end to the container to initiate wrapping of the label around the container due to turning of the support, said means for turning the support then continuing to do so until the trailing end of the label overlaps the leading end, a plurality of heatable heat sealing members arranged in a circle radially inwardly of said circular path of said container supports and aligned respectively, with the corresponding number of container supports, said heat sealing members being carried on the turntable for rotation therewith, control means including means for urging the heat sealing members in succession into heat exchange sealing contact with the label overlap region of the respective containers as the trailing ends of the labels become overlapped, said control means releasing said heat sealing members in succession from being urged after said members are maintained in contact with the respective overlapped label ends for a predetermined corresponding rotational angle of the turntable and the heat sealing members carried thereon to provide for releasing said heat sealing member from the labeled containers with which the members have been in contact, and means for conveying the containers from the turntable after the heat sealing is complete.

6. The apparatus according to claim 5 wherein said transfer device is a rotationally driven vacuum cylinder for carrying individual labels through a circular path and releasing said leading end of the label for it to contact said container, and including a cutter and means for feeding to said cutter a web containing a series of labels, and means for transferring the individual labels to said transfer device after the labels are cut from the web.

7. The apparatus according to claim 6 wherein said means for turning said supports begins turning a support and the container thereon when said container arrives at said vacuum cylinder for being contacted by the leading end of the label and said support continues turning at least until the label is completely wrapped around the container.

8. The apparatus according to claim 7 wherein said means for turning said support for the container is stopped from turning when the overlapped region of said leading and trailing ends is presented toward a heat sealing member.

9. The apparatus according to claim 5 including a centering bell mounted to said turntable proximate to each turntable, said centering bell being operative to engage and stabilize a container after it is loaded onto a container support.

10. The apparatus according to claim 5 including an adhesive applicator arranged adjacent said turntable between said infeed means and said transfer device for applying adhesive to a passing container on a support.

11. Apparatus according to any one of claims 5, 6, 9, 10, 7 or 8 including at least one stationary guide element positioned in the region beyond said transfer device, as viewed in the direction of rotation of the turntable, contiguous to the circular path of the containers for reacting against the portion of the label extending away from where the adhesive is interposed between said leading end of the label and the container, said guide element acting to pull the label taut and press it onto the container.

12. Apparatus according to any one of claims 5, 6, 9, 10, 7 or 8 including a pressing element adjacent each container support and mounted to the turntable for revolving therewith and acting to press the label on the containers, respectively.

13. Apparatus according to claim 5 wherein said control means for urging the heat sealing member into contact with the region of overlapped label ends includes adjustment means for determining the time between said heat sealing member contacting said region and operation of said means for retracting said heat sealing member to allow holding the heat sealing time constant for different rotational speeds of the turntable.

14. Apparatus for applying a label composed of heat sealable material to a container comprising:

means (7) for severing individual labels (2) from a web, a transfer device (14) to which individual labels are transferred in sequence and from which the leading ends of the individual labels are placed in contact with the containers (1), respectively, conveyor means (10) for conveying containers past said transfer device, means (12) for interposing at least one narrow region (13) of adhesive at a position between the leading end of label and the container such that adhesion between the label and container occurs at a position that is spaced from the extremity of the leading end of the label so there is an adhesive-free region between the label and container extending from said extremity of the leading end of the label to the position of the adhesive, support members (16) on said conveyor means for supporting the containers and means (20) for rotating the support members operative at least as soon as the leading end of the label makes contact with the container and adhesion occurs to effect wrapping of the label around the rotating container for the adhesive-free trailing end of the label to overlap the adhesive-free extremity of the leading end, and heat sealing members for pressing against the containers and for applying heat to the overlapping trailing end of each label in the adhesive-free region of the trailing end to heat seal the trailing end to the leading end.

15. Apparatus for applying a label composed of heat sealable material to a container comprising:

means for drawing a web (8) of labels from a source, means (7) for severing individual labels (2) from the web, a transfer device (14) to which individual labels are transferred in sequence and from which the leading ends of the individual labels are placed in contact with the containers (1), respectively, conveyor means (10) for conveying containers past said transfer device, means (12) for interposing at least one narrow region of adhesive at a position between the leading end of the label and the container such that a narrow region of the leading end of the label extending from at least near the extremity of the leading end adheres to the container at said position of the adhesive, support members (16) on the conveyor means for supporting the containers for rotation and means (20) operative to rotate the support members at least as soon as the leading end of the label makes contact with the container and adhesion occurs to effect wrapping the label around the container for the adhesive-free trailing end of the label to overlap the leading end, and heat sealing means for pressing against the respective containers on the adhesive-free trailing end of the label that overlays said narrow region of adhesive to heat seal the trailing end of the label to the leading end.

16. Apparatus for applying a label composed of heat sealable material to a container comprising:

means for drawing a web (8) of labels from a source, means (7) for severing individual labels (2) from the web, a transfer device (14) to which individual labels are transferred in sequence and from which the leading ends of the individual labels are places in contact with the containers (1), respectively, conveyor means (10) for conveying containers past said transfer device, means (12) for applying at least one strip (13) of adhesive to the containers, respectively, at a position of the container and the container arriving at said transfer device relative to said position of the adhesive such that the leading end of the label overlays and adheres to a first portion of the adhesive strip and leaves a second portion exposed, support members (16) on said conveyor means for supporting the containers for rotation and means (20) for rotating said support members at least as soon as the leading end of the label contacts the first portion of the adhesive to effect wrapping of the label around the container such that an adhesive-free region adjacent the end extremity of the trailing end of the label overlays the adhered leading end of the label and a region of the trailing end adjacent the adhesive-free region adheres to said second exposed portion of the strip of adhesive, and heat sealing means for pressing against the respective containers at the adhesive-free region of the trailing end of the label to heat seal the trailing end of the label to the leading end.

17. Apparatus for applying to a container a label having leading and trailing ends and composed of heat sealable material, comprising:

means for adhering to a cylindrical region of the container the leading end of the label, means for wrapping the label around said cylindrical region such that the trailing end of the label overlaps the leading end of the label, a heat sealing member having a rigid concave curved surface and means for advancing the member for its concave curved surface to contact the overlapped trailing end of the label for heat sealing the overlapped trailing end of the underlying leading end along a line parallel to the axis of the cylindrical region, said cylindrical region of the container having a predetermined convex radius of curvature, said concave curved surface of the heat sealing member having a radius of curvature $R_s$ which is slightly greater than the convex radius of curvature $R_G$.

18. Apparatus for applying a label composed of heat sealable material to a container comprising:

means for drawing a web (8) of labels from a source, means (7) for severing individual labels (2) from the web, a transfer device (14) to which individual labels are transferred in sequence and from which individual labels are transferred to containers (1), respectively, conveyor means (10) for conveying containers past said transfer device, means (12) for interposing at least one first narrow strip of adhesive between the leading end of the label and container at a position spaced from the extremity of the leading end so there is an adhesive-free region at the end of the label and for interposing at least one narrow second strip of adhesive between the trailing end of the label and container at a position spaced from the extremity of the trailing end of the label so there is an adhesive-free region at the trailing end of the label, the containers arriving at the transfer device at such time that the label becomes adhered to the container by way of the first strip of adhesive adjacent the adhesive-free region at the extremity of the leading end of the label, support members (16) on said conveyor means for supporting the containers for rotation and means (20) for rotating the support members at least as soon as the adhesion of the label and container occurs at the position where the first adhesive strip is interposed between the label and container adjacent the adhesive-free region to effect wrapping the label around the container such that adhesion of the trailing end of the label and the container occurs at the position where the second strip of adhesive is interposed adjacent the adhesive-free region at the trailing end of the label so the adhesive-free region at the trailing end of the label overlaps the adhesive-free region on the leading end of the label, and heat sealing means for pressing against the respective containers at the adhesive-free region of the trailing end of the label to heat seal the adhesive-free region of the trailing end of the label to the adhesive-free region of the leading end.

19. The apparatus according to any one of claims 14, 15, 16 or 18 wherein said conveyor means is a turntable (15) mounted for rotating about a vertical axis, said support members (16) arranged in circumferentially spaced apart relationship on the turntable for transporting the containers in a circular path, infeed means (17) for directing containers onto the support members in sequence, said heat sealing means are heated members arranged radially inwardly of the circular path of the container support members on the turntable and in radial alignment, respectively, with the support members, said heated members being carried on the turntable for rotation therewith, and control means including means for urging the heat sealing members in succession into heat exchange sealing contact with the label overlap region of the respective containers as the trailing ends of the labels become overlapped, said control means releasing said heat sealing members in succession from being urged after said members have been maintained in contact with the respective overlapped label ends for a time period determined by the rotational rate of the turntable.

20. Apparatus according to claim 19 wherein:

said transfer device comprises a vacuum drum (14) driven in one rotational direction and said container supports (16) are driven in the opposite rotational direction when the labels are transferred from the drum (14) for the leading end regions of the respective labels to adhere to the containers on the supports, a label wrapping element in the form of a guide member (21) fixedly mounted at a position displaced in the direction of turntable rotation by a small amount from the place where the leading end of the label from transfer device (14) is adhered to the container, said guide member having a convex curved surface concentric to the circular path of the containers and faced radially outwardly of the turntable so the rotating containers make wiping contact with the curved surface as the containers are transported on the turntable for causing the unadhered length of the labels to wrap around the containers.

21. Apparatus according to claim 19 wherein:

said transfer device comprises a vacuum drum (14) driven in one rotational direction and said container supports (16) are driven in the opposite rotational direction when the labels are transferred from the drum for the leading end regions of the respective labels to adhere to the containers on the supports, a label wrapping element in the form of a guide member (21) fixedly mounted at a position displaced by a small amount in the direction of turntable rotation from the place where the leading ends of the label from the transfer device (14) is adhered to the container, said guide member having a concave curved surface concentric to the circular path of the containers and faced radially inwardly of the turntable so the rotating containers make wiping contact with the curved surface as the containers are transported on the turntable for causing the unadhered length of the labels to wrap around the containers.

22. Apparatus according to claim 19 wherein said control means for urging the heat sealing member into contact with the region of overlapped label ends includes adjustment means for determining the time between said heat sealing member contacting said region and operation of said means for retracting said heat sealing member to allow holding the heat sealing time constant for different rotational speeds of the turntable.

23. Apparatus according to claim 19 wherein said control means comprises first and second cams together presenting an arcuate profile surface onto which said heat sealing members run to effect urging said heat sealing members onto respective containers, at least one of said cams being rotatable relative to the other to allow selectively lengthening and shortening said surface to provide for varying the time during which said heat sealing members remain in contact with said overlapped ends of the label.

24. Apparatus according to any one of claims 14, 15 16 or 18 wherein said means for rotating the supports for the respective containers is constructed and arranged to initiate rotation of a container no later than when the container is contacted by the leading end of the label and is constructed for continuing to turn said supports until the label is wrapped around the container.

25. Apparatus according to any one of claims 14, 15, 16 and 18 wherein said means for rotating the supports, respectively, for the containers is constructed and arranged for stopping the rotation of each support at least by the time when the overlapped region of the label on the container is contacted by the heat sealing member.

26. Apparatus according to any one of claims 14, 15, 16 or 18 wherein said conveyor means is a turntable (15) driven rotationally about a vertical axis, said support members (16) arranged in circumferentially spaced apart relationship on the turntable for transporting the containers in a circular path, infeed means (17) for loading containers onto the support members in sequence, said means (12) for applying adhesive to the containers is arranged for applying the adhesive to the containers before the containers arrive at the transfer device (14), a label wrapping element in the form of a curved guide member (21) mounted in a position displaced by a small amount in the direction of turntable rotation from the place where the leading end of the label from the transfer device (14) is adhered to the container, said means (20) for rotating the support members (16) being constructed and arranged to rotate said members (16) being constructed and arranged to rotate said members and the respective containers thereon at least until the trailing end of the label is wrapped in overlapping relation to the leading end and then to stop rotation of the support members, said heat sealing means comprising a stationary heating element (32) having a curved surface arranged substantially concentric to the said circular path of the containers on the support members (16) of the turntable (15) circumferentially adjacent said curved guide member (21), and a heat transfer belt (33) and means for translating the belt along the heating element (32) such that the non-rotating containers that are orbiting with the turntable present their overlapped region of the label to the belt for heat sealing the trailing end to the leading end of the label.

27. Apparatus according to any one of claims 14, 15, 16 or 18 wherein said conveyor means is a turntable (15) driven rotationally about a vertical axis, said support members (16) arranged in circumferentially spaced apart relationship on the turntable for transporting the containers in a circular path, a curved label guide member (21) mounted in a position displaced by a small amount in the direction of turntable rotation from the place where the leading end of the label from the transfer device (14) is adhered to the container, said means (20) for rotating the support members (16) being constructed and arranged to rotate said members and the respective containers thereon during and after the trailing end of the label is wrapped under the influence of the guide member 21 in overlapping relation to the leading end, said heat sealing means comprising a plurality of rotationally driven heated rollers (36) arranged along said circular path of the containers for the containers to make tangential contact with the rollers in the region of the overlapping ends of the label for heat sealing said ends.

28. Apparatus according to any one of claims 14, 15, 16 or 18 wherein the label is composed of a heat shrinkable film that is applied to the containers in unshrunken condition, the containers have a top end and a bottom end and a cylindrical body portion between the ends and a portion sloping upwardly toward the axis of the cylindrical body adjacent at at least one of the ends of the container, said label having sufficient width for an edge of the label to extend over and be spaced from the sloping portion while still not contacting said sloping portion even after said overlapping trailing end of the label is heat sealed to the leading end to provide for applying heat to the portion of the container to shrink the extending portion onto the sloping portion.

29. The apparatus according to any one of claims 1, 5, 14, 15, 16 or 18 including a pressing device arranged for applying pressure to the trailing end of the label adjacent the extremity of the end when wrapping the label on the container is complete for maintaining the trailing end of the label in a predetermined position at least until a heat sealing member engages the container where the trailing end overlaps the leading end of the label.

30. The apparatus according to claim 29 wherein said pressing device is mounted adjacent each of the heat sealing members on the turntable for revolving therewith.

31. The apparatus according to claim 29 wherein said pressing device comprises an element movably mounted to the heat sealing members, respectively, a roller on the element, and means for biasing the element in a direction for the roller to press against the label at the trailing end.

32. The apparatus according to claim 29 wherein said pressing device comprises an element movably mounted to the turntable adjacent each of the heat sealing members for revolving with the turntable, a roller on the element and, means for biasing said element in a direction for the roller to press against the label at the trailing end.

33. The apparatus according to any one of claims 14, 15, 16 or 18 including a pressing device arranged for applying pressure to the trailing end of the label adjacent the extremity of the end when wrapping of the label on the container is complete for maintaining the trailing end of the label in a predetermined position at least until a heat sealing member engages the container where the trailing end of the label overlaps the leading end.

34. The apparatus according to claim 33 wherein said pressing device is mounted adjacent each of the heat sealing members on said conveyor means for moving therewith.

35. The apparatus according to claim 33 wherein said device comprises an element movably mounted to the heat sealing members, respectively, a roller on the element, and means for bracing the element in a direction for the roller to press against the label at the trailing end.

36. The apparatus according to claim 33 wherein said device comprises an element movably mounted to said conveyor means adjacent each of the heat sealing members for moving with said conveyor means, a roller on the element and means for biasing the element in a direction for the roller to press against the label at the trailing end.

37. The apparatus according to any one of claims 1, 5, 14, 15, 16 or 18 wherein said heat sealing device is adapted for sealing overlapping leading and trailing ends of a label that overlap on a cylindrical portion of the container where the cylindrical portion has a predetermined radius of curvature $R_G$ and a surface on said heat sealing device that interfaces with the container to effect a seal has a radius of curvature $R_S$ which is slightly greater than $R_G$.

38. The apparatus according to any one of claims 1, 5, 14, 15, 16 or 18 wherein the container has a cylindrical body and at least one end portion of the container which is integral with and coaxial with the body slopes radially inwardly toward the axis of the cylindrical body, the label being composed of heat shrinkable material and having at least one edge portion coextensive with its length, the edge portion extending in the axial direction beyond the body and concentric to the sloped end portion of the container but not contacting said end portion when said label is wrapped around the container and heat sealed, means for transporting the containers along a predetermined path and for rotating the containers while being transported, at least one nozzle arranged along said path for directing hot air against said edge portion of the label to shrink the label onto the sloped end portion of the container.

39. The apparatus according to claim 38 wherein the path along which the containers are transported is circular, and there are a plurality of nozzles arranged along an arc that is concentric to the circular path for directing hot air consecutively against said edge portion of the label to shrink the edge portion onto the container.

40. The apparatus according to claim 39 wherein said nozzles, respectively, have a hot air discharge slot that extends along said arc.

41. The apparatus according to claim 38 wherein the path along which said containers are transported is circular and there are three nozzles positioned along a 180° arc that is concentric to the circular path of the containers, two of the nozzles positioned at opposite ends of the arc and the third nozzle positioned intermediate the end of the arc for directing hot air radially inwardly to said edge portion of the label.

42. Apparatus according to claim 5 wherein said control means comprise first and second cams together presenting an arcuate profile surface onto which said heat sealing members run to effect urging said heat sealing members onto respective containers, at least one of said cams being rotatable relative to the other to allow selectively lengthening and shortening said surface to provide for varying the time during which said heat sealing members remain in contact with said overlapped ends of the label.

* * * * *